United States Patent [19]

Auer et al.

[11] Patent Number: 4,764,146

[45] Date of Patent: Aug. 16, 1988

[54] TOY PUPPY PICKUP TRUCK HAVING DOG HOUSE

[75] Inventors: Robert T. Auer, East Stroudsburg, Pa.; Richard L. Keats, Sands Point, N.Y.

[73] Assignee: Buddy L Corporation, New York, N.Y.

[21] Appl. No.: 43,481

[22] Filed: Apr. 27, 1987

[51] Int. Cl.[4] ..... A63H 13/00; A63H 17/06; A63H 17/26; A45C 13/10

[52] U.S. Cl. ..... 446/279; 446/428; 446/470; 206/1.5; 206/807; 220/315; 292/147

[58] Field of Search ..... 446/279, 281, 295, 288, 446/470, 471, 427, 428, 269, 86, 87, 88, 93, 94, 248; 52/66, 69; 292/147, 145; 312/263, 275, 276; 206/1.5, 807; 220/315, 323, 327

[56] References Cited

U.S. PATENT DOCUMENTS

| | | | |
|---|---|---|---|
| 300,799 | 6/1884 | Ricker | 446/281 |
| 444,015 | 1/1891 | Porter | 220/315 |
| 1,424,982 | 8/1922 | Budin | 446/288 |
| 1,573,579 | 2/1926 | Ross | 292/147 X |
| 1,589,020 | 6/1926 | Siebenhaar | 446/288 |
| 2,100,622 | 11/1937 | Adams | 292/147 |
| 3,675,365 | 7/1972 | Silva | 446/465 X |
| 4,077,155 | 3/1978 | Bruntmyer | 446/46 |
| 4,244,144 | 1/1981 | Goldberg et al. | 446/470 X |
| 4,300,674 | 11/1981 | Davet | 206/1.5 X |

FOREIGN PATENT DOCUMENTS

| | | | |
|---|---|---|---|
| 2012175 | 7/1979 | United Kingdom | 446/279 |
| 2068751 | 8/1981 | United Kingdom | 446/279 |
| 2159721 | 12/1985 | United Kingdom | 446/93 |

*Primary Examiner*—Robert A. Hafer
*Assistant Examiner*—D. Neal Muir
*Attorney, Agent, or Firm*—Michael Ebert

[57] ABSTRACT

A toy vehicle in the form of a pickup truck on whose rear bed are mounted a pair of miniature dog houses in side-by-side relation, each having a triangular roof hinged to the rear wall of the house. Depending from the front end of each roof is a front wall having an arched opening defining the entry to the dog house which is occupied by a miniature puppy whose head projects through the entry. The puppy is otherwise confined within the doghouse and is removable therefrom only by lifting the roof. To discourage unauthorized removal of a puppy from its doghouse when the toy is on sales display, each roof is provided on its underside with a latching lug having a slot therein aligned with holes in the sidewalls of the dog houses. Insertable into these holes and going through the lugs is a disposable locking pin whose tip is so formed as to frictionally engage the side wall hole in which it is received. Hence to release the roofs and obtain access to the puppies, the pin has to be forcibly pulled out.

7 Claims, 3 Drawing Sheets

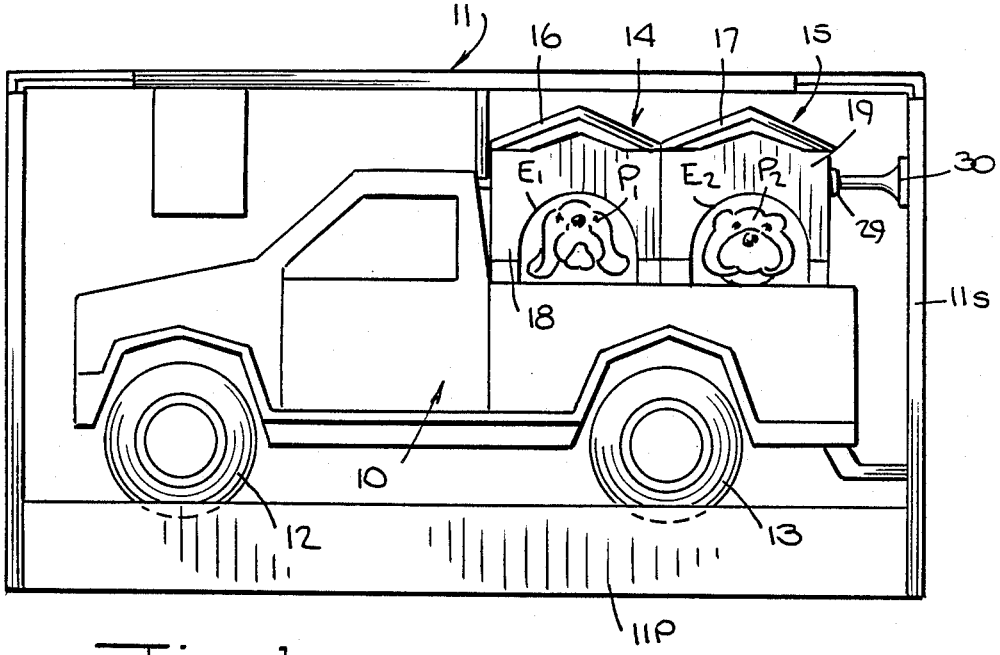
Fig. 1.
Fig. 2.
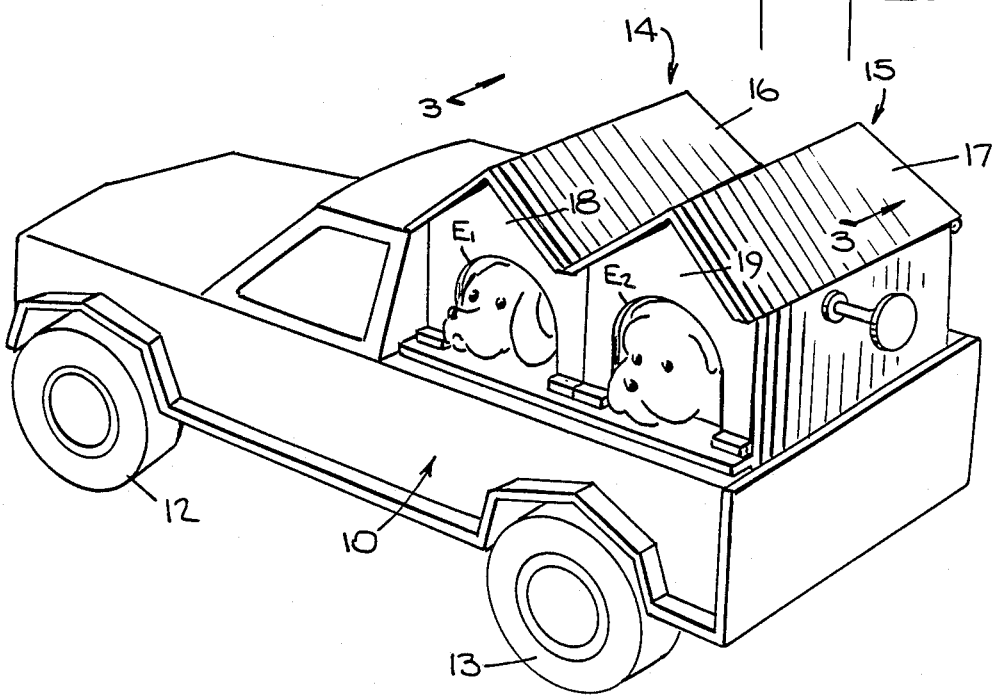

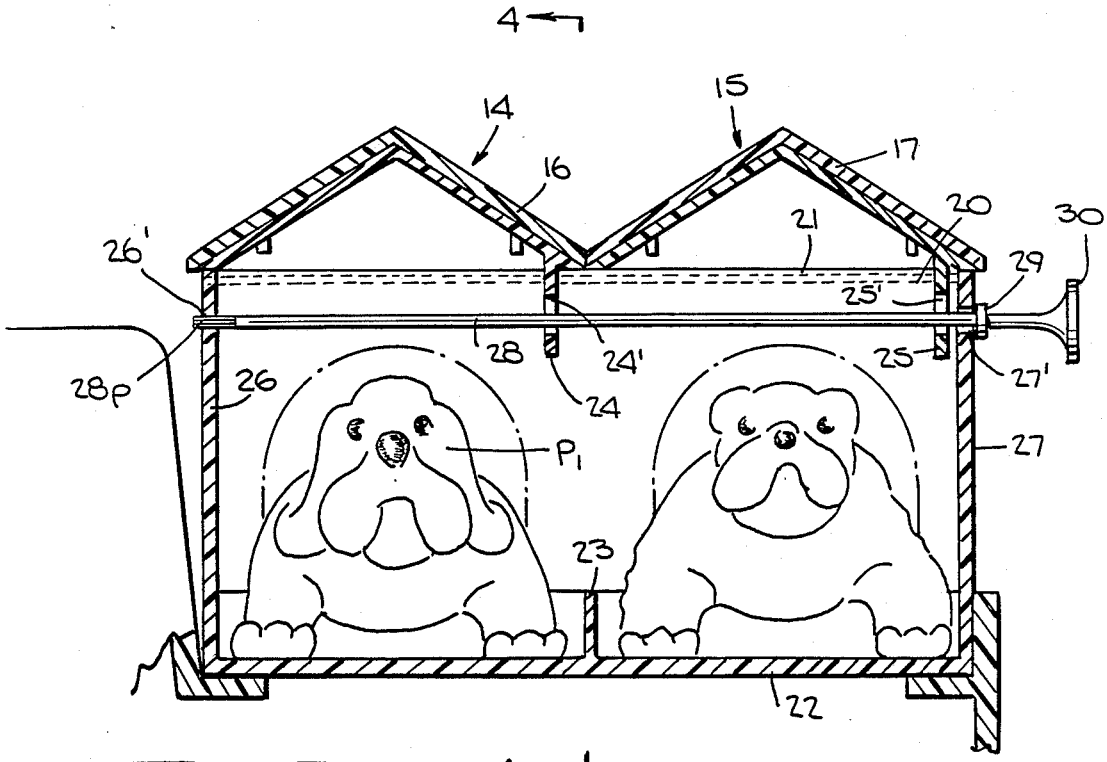
Fig. 3.
Fig. 4.
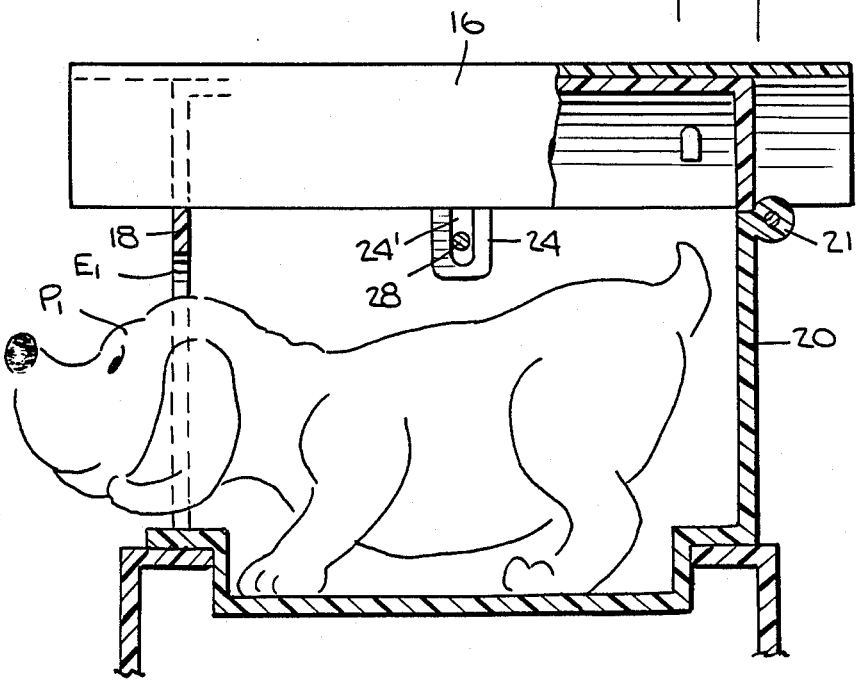

TOY PUPPY PICKUP TRUCK HAVING DOG HOUSE

BACKGROUND OF INVENTION

1. Field of Invention

This invention relates generally to toy vehicles, and more particularly to a toy pick-up truck on whose rear bed are mounted at least two miniature dog houses in side-by-side relation, each occupied by a miniature puppy whose head projects from the entry to the dog house.

2. Status of Prior Art

The concern of this invention is with a toy pickup truck on whose rear bed are mounted in side-by-side relation at least two miniature dog houses so that the vehicle serves, as it were, as a transport carrier for puppies who are confined to these houses until the truck reaches its destination, at which point the puppies are taken out.

In order to make it possible for a child who plays with this toy to remove the miniature puppies from their dog houses so that he can handle and engage in various play activities with these puppies, the roof of each dog house is hinged so that it can be raised to provide access to the dog house interior. The head of each puppy projects out of the entry to the dog house, but one cannot remove the puppy by way of this entry which is too narrow to admit the puppy's body.

The problem with this toy pickup truck is that it is possible to steal the puppies without at the same time taking the truck. Thus, when, as is often the case, the toy pickup truck is on sales display on a counter or shelf in a retail store, it is then fairly difficult for a shoplifter, without being observed to remove the toy from its display site; for the truck is relatively large and conspicuous and cannot easily be concealed. But it is much easier for a shoplifter to raise the doghouse roof and take out a miniature puppy, for this puppy can be grasped and concealed in one hand.

Hence the need exists in a toy of this type for some means to discourage one who is not authorized to do so from lifting a dog house roof to remove the puppy occupying this house. A positive locking mechanism for this purpose would not be acceptable, for this would require a key or other means to unlock the mechanism. This mechanism would unduly complicate the toy and also make it more difficult to play with.

The need exists, therefore, for a non-positive locking means that would be effective under those circumstances when the toy is subject to theft, but which, when the toy is in the possession of its rightful owner, could then be withdrawn and discarded, so that the player is then free to lift the roofs and remove the miniature puppies at will. These temporary locking means must also take into account the nature of the packaging for the toy.

It is now common practice to package toy vehicles in open front cartons so that a prospective customer does not have to rely on a photograph or drawing of the toy on a closed box, but is able to see for himself the vehicle being offered for sale even though it is in a protective carton.

In order to prevent the toy vehicle from falling out of the open front of the carton when the carton is handled or shipped, or from being easily withdrawn through this opening, it is known to provide an open front carton arrangement in which the wheels of the vehicle are so trapped as to resist removal of the vehicle from the carton. One such security arrangement is shown in the Keats et al. U.S. Pat. No. 3,376,353.

But though an open front carton of the security type is suitable for a toy pickup truck as above described and makes it difficult for one to remove the vehicle from the carton despite its open front, this carton does not preclude raising the hinged roof of a dog house to remove the miniature puppy therefrom.

SUMMARY OF INVENTION

In view of the foregoing, the chief object of this invention is to provide, in conjunction with dog houses mounted on the rear bed of a toy pickup truck, a temporary, non-positive protective device adapted to discourage the unauthorized removal of miniature puppies occupying the dog houses; for it takes a significant degree of force to withdraw the protective device.

More particularly, an object of this invention is to provide a device of the above type which is so arranged that when the toy vehicle is packaged in an open front carton, access to the protective device is then denied, thereby precluding the withdrawal of the device while the vehicle is in its carton.

Also an object of the invention is to provide a temporary protective device whose only exposed part is a knob so that the appearance of the dog houses is not impaired by the device.

Briefly stated, these objects are attained in a toy vehicle in the form of a pickup truck on whose rear bed are mounted a pair of miniature dog houses in side-by-side relation, each having a triangular roof hinged to the rear wall of the house. Depending from the front end of each roof is a front wall having an arched opening defining the entry to the dog house which is occupied by a miniature puppy whose head projects through the entry. The puppy is otherwise confined within the doghouse and is removable therefrom only by lifting the roof. To discourage unauthorized removal of a puppy from its doghouse when the toy is on sales display, each roof is provided on its underside with a latching lug having a slot therein aligned with holes in the sidewalls of the dog houses. Insertable into these holes and going through the lugs is a disposable locking pin whose tip is so formed as to frictionally engage the side wall hole in which it is received. Hence to release the roofs and obtain access to the puppies, the pin has to be forcibly pulled out.

OUTLINE OF DRAWINGS

For a better understanding of the invention as well as other objects and further features thereof, reference is made to the following detailed description to be read in conjunction with the accompanying drawings, wherein:

FIG. 1 is an elevational view of a toy miniature pickup truck in accordance with the invention packaged in an open front carton;

FIG. 2 is a perspective view of the toy in its temporarily protected state;

FIG. 3 is a longitudinal section taken in the plane indicated by line 3—3 in FIG. 2;

FIG. 4 is a transverse section taken in the plane indicated by line 4—4 in FIG. 3;

DESCRIPTION OF INVENTION

Figure 5:
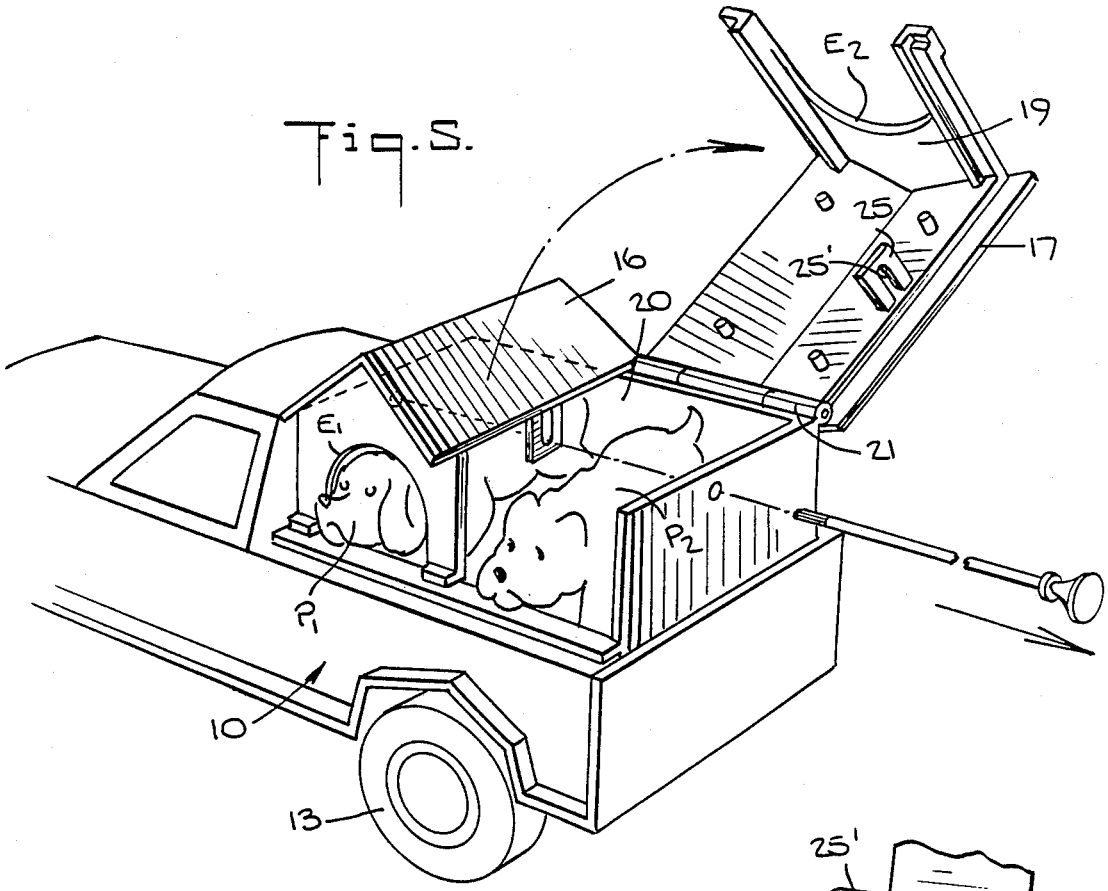
FIG. 5 is a perspective view of the toy with the protective device withdrawn and one of the dog house roofs lifted to provide access to a miniature puppy therein.

Referring now to FIGS. 1 and 2, there is shown a miniature toy pickup truck, generally designated by reference numeral 10, packaged within an open front cardboard carton 11. This carton may be of the type illustrated in the above-identified Keats et al. patent or of any other known type.

The toy vehicle is provided with a chassis supporting a front set of wheels 12 and a rear set of wheels 13. Behind the cab of the vehicle is a flat bed on which is mounted a pair of miniature dog houses 14 and 15 in side-by-side relation. These are occupied by miniature puppies $P_1$ and $P_2$.

The vehicle in carton 11 rests on a hollow platform 11P having nesting slots therein which receive the bottom portions of the four wheels so that the vehicle is trapped within the carton and will not fall out of its open front. Hence to remove the vehicle from the carton, it must be forcibly pulled out to overcome the resistance presented by the platform.

Each dog house has a triangular roof (16 and 17) and a front wall (18 and 19). The front walls have an arched opening therein to define entries $E_1$ and $E_3$ through which project the heads of the puppies $P_1$ and $P_2$ whose bodies occupy the dog houses. Because these bodies are larger and wider than the heads, the puppies cannot be pulled out through the dog house entries.

As shown in FIGS. 3 and 4, dog houses 14 and 15 have a common back wall 20 to which the rear ends of roofs 16 and 17 are hinged by a hinge 21. The front walls 18 and 19 are secured to and depend from the front end of roofs 16 and 17 so when the roof is raised by swinging it open, as shown in FIG. 5, the front wall is also lifted to provide access to the miniature puppy occupying the dog house. The puppy rests on a bottom wall 22 common to both dog houses, a partition 23 separating the houses. Thus, the two dog houses are integrated and form a twin dog house.

Each roof is provided with a latching lug (24 and 25) which depends vertically therefrom. When roofs 16 and 17 are in their down position, these lugs are then parallel to the side walls 26 and 27 of the twin dog house. These side walls are in parallel relation and are at right angles to the longitudinal axis of the vehicle. Lugs 24 and 25 have slots therein (24' and 25') which are in alignment with holes 26' and 27' in the side walls.

Inserted into the side wall slots 26' and 27' and passing through the latching lug slots 24' and 25' is a pin 28 whose tip 28*p* is received in side wall hole 26'. The other end of the pin terminates in an annular stop 29 which when the pin is fully inserted rests against the exterior surface of side wall 27, a knob 30 being integrally joined to stop 29.

Figure 6:
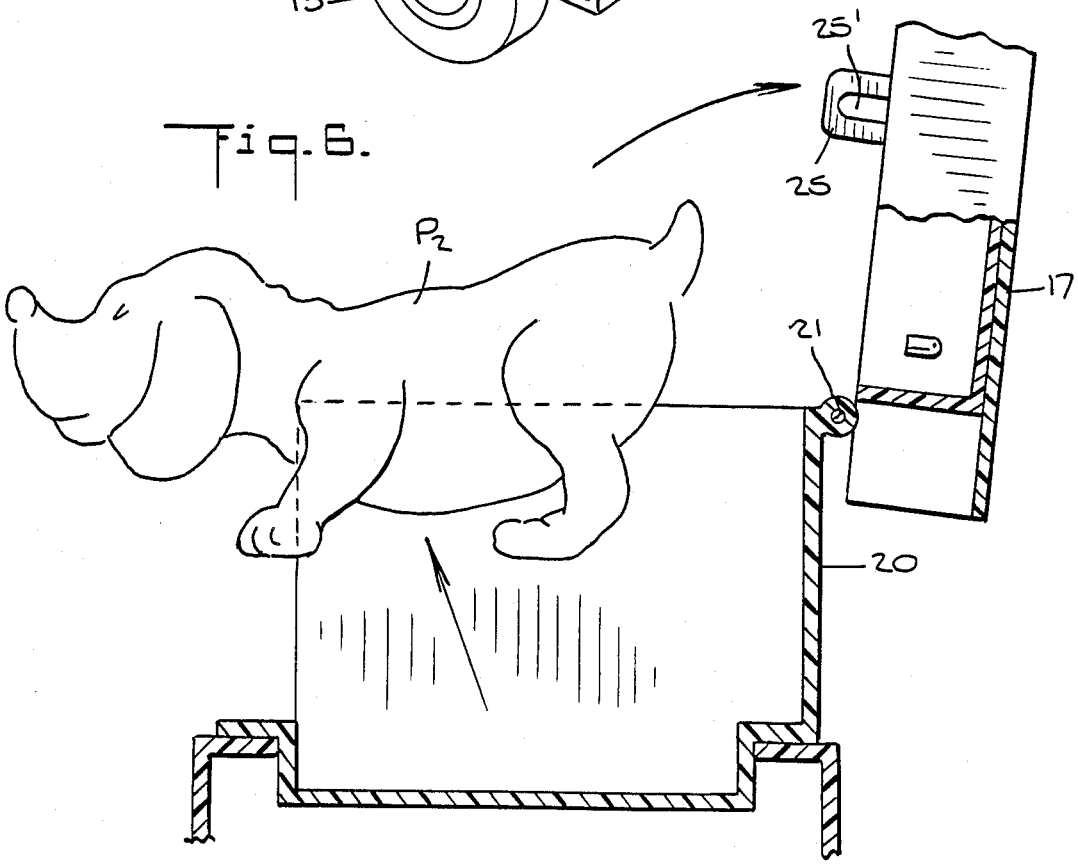
FIG. 6 shows the puppy being removed from its dog house.

The tip 28*p* of pin 28 is knurled or otherwise formed so that it is not freely received in hole 26' of the front side wall 26 but must be forced therein. The pin is preferably formed of a synthetic plastic material such as PVC or polyethylene, which is compressible so that it is frictionally engaged when the tip is axially forced into its side wall hole. Hence once the protective pin is fully in place as shown in FIG. 3, it can only be removed by grasping knob 30 and using sufficient force to effect disengagement of tip 28*p* from its hole, at which point, the protective device can easily be withdrawn. Once the device is withdrawn, then, as shown in FIG. 6, one may swing up a dog house roof, in this instance roof 17, and remove the puppy $P_2$ therefrom.

When the toy vehicle is seated within an open front carton as shown in FIG. 1, knob 30 of the protective device then abuts the rear side wall $11_s$ of the carton. Hence while it is possible for an individual to grasp knob 30 through the open front, he cannot axially pull out the protective pin, for this action is blocked by the carton side wall.

Thus, the protective device, when the toy vehicle is taken out of its carton, can only be withdrawn by exerting some force to do so, thereby discouraging a shoplifter from taking this action in order to steal a puppy from a doghouse. But when the vehicle is in its carton, even though the front is open, it is impossible to withdraw the protective device without firs breaking the carton.

While there has been shown and described a preferred embodiment of a toy puppy pickup truck in accordance with the invention, it will be appreciated that many changes and modifications can be made therein without, however, departing from the essential spirit thereof. Thus, instead of a pair of dog houses in side-by-side relation, the toy vehicle may be provided with only one dog house or with more than two dog houses. But whatever the arrangement, the protective pin must enter side wall holes and a slot in the roof latching lug. Also, in practice the vehicle need not be in a pick-up truck format but may be in any other form as long as it has a flat base into which dog houses can be mounted. And instead of a single latching lug on each roof, a pair of spaced parallel latching lugs may be used to obtain greater security, the lugs being adjacent opposite sides of the roof.

I claim:

1. A toy vehicle comprising:

A. a chassis supporting a front set of wheels, a rear set of wheels and a rear flat bed;

B. at least one miniature dog house mounted on the flat bed, said dog house having parallel side walls at right angles to a longitudinal axis of the vehicle, a back wall parallel to this axis, and a roof hinged to the back wall and having a front wall depending from a front end of the roof whereby when the roof is swung open, the front wall is raised therewith, said front wall having an arched opening therein defining the apparent entry to the dog house:

C. a miniature toy puppy occupying the dog house, the puppy having a head projecting from said entry, the puppy having a body so proportioned that it cannot pass thorough the entry, whereby to remove the puppy from the dog house one must first lift the roof; and D. temporary protective means to discourage an unauthorized person from lifting the roof to remove the puppy, said protective means being constituted by a latching lug depending from the roof and having a slot therein in alignment with holes in said side walls, and a pin which is insertable into the holes and passes through the slot, the tip end of the pin going into the hole in its related side wall, the other end of the pin terminating in a stop which engages the exterior of the rear side wall and is joined to a knob.

2. A toy vehicle as set forth in claim 1, wherein said tip is so formed that when inserted in its side wall it frictionally engages its hole.

3. A toy vehicle as set forth in claim 2, wherein said pin is formed of a synthetic plastic material which is compressible.

4. A toy vehicle as set forth in claim 1, wherein said dog house is a twin dog house having a pair of roofs and a partition therein to define spaces for two miniature puppies.

5. A toy vehicle as set forth in claim 1 in a pickup truck formation with the bed thereof placed behind a cab.

6. A toy vehicle as set forth in claim 1 in combination with an open-front carton occupied by the vehicle, said carton having a side wall which is engaged by said knob to prevent withdrawal of said pin.

7. The combination as set forth in claim 6, wherein said carton has a hollow platform provided with slots to receive the bottom portions of the wheels and thereby trap the vehicle in the carton.

* * * * *